United States Patent [19]

Inokuti et al.

[11] 4,280,856

[45] Jul. 28, 1981

[54] METHOD FOR PRODUCING GRAIN-ORIENTED SILICON STEEL SHEETS HAVING A VERY HIGH MAGNETIC INDUCTION AND A LOW IRON LOSS

[75] Inventors: Yukio Inokuti; Yoh Shimizu, both of Chiba; Hiroshi Shimanaka, Funabashi, all of Japan

[73] Assignee: Kawasaki Steel Corporation, Kobe, Japan

[21] Appl. No.: 109,524

[22] Filed: Jan. 4, 1980

[51] Int. Cl.[3] ..... H01F 1/04

[52] U.S. Cl. ..... 148/111; 148/31.55; 75/123 L

[58] Field of Search ..... 148/110, 111, 112, 113, 148/31.55; 75/123 A, 123 AA, 123 G, 123 L

[56] References Cited

U.S. PATENT DOCUMENTS

| | | | |
|---|---|---|---|
| 3,218,202 | 11/1965 | Ganz | 148/111 |
| 3,556,873 | 1/1971 | Malagari et al. | 148/31.55 |
| 3,802,936 | 4/1974 | Goto et al. | 148/111 |
| 3,853,641 | 12/1974 | Sakakura et al. | 148/111 |
| 3,908,432 | 9/1975 | Ichiyama et al. | 148/111 |
| 3,932,234 | 1/1976 | Imanaka et al. | 75/123 L |
| 3,986,902 | 10/1976 | Regitz | 148/111 |
| 4,174,235 | 11/1979 | Fiedler | 148/111 |

*Primary Examiner*—Aaron Weisstuch
*Assistant Examiner*—John P. Sheehan
*Attorney, Agent, or Firm*—Balogh, Osann, Kramer, Dvorak, Genova & Traub

[57] ABSTRACT

Grain-oriented silicon steel sheets having a very high magnetic induction and a low iron loss are produced by using a small amount of Mo and Sb and a slight amount of at least one of Se and S as an inhibitor for growing crystal grains.

2 Claims, 4 Drawing Figures o : Sample A
Δ : Sample B
□ : Sample C
Mo+Se+Sb Addition
Se+Sb Addition
Se Alone Addition
Magnetic Induction B10 (Wb/m2)
1.98
1.96
1.94
1.92
1.90
1.88
1.86
1.84
40
50
60
70
80
90
Final Cold Rolling Reduction Rate (%)

o : Sample A
Δ : Sample B
□ : Sample C
Iron Loss W17/50 (W/Kg)
1.6
1.5
1.4
1.3
1.2
1.1
1.0
1.75
1.80
1.85
1.90
1.95
2.00
2.05
Magnetic Induction B10 (Wb/m2)

METHOD FOR PRODUCING GRAIN-ORIENTED SILICON STEEL SHEETS HAVING A VERY HIGH MAGNETIC INDUCTION AND A LOW IRON LOSS

The present invention relates to a method for producing grain-oriented silicon steel sheets or strips having an easy magnetization axis <100> in the rolling direction of the steel sheets.

The magnetic properties of the grain-oriented steel sheets are expressed by both magnetizing properties of the magnetic induction $B_{10}$ and iron loss $W_{17/50}$. The former magnetic induction is evaluated by the $B_{10}$ value at a magnetizing force 1000 A/m, whereas the latter is evaluated by the iron loss value $W_{17/50}$.

In order to improve the magnetic properties of the oriented silicon steel sheets, it is of particular importance to increase the magnetic induction and reduce the iron loss. For this purpose, firstly it is necessary to arrange the highly aligned <100> axis of the secondary recrystallized grains in the steel sheet uniformly in the rolling direction and secondly to make impurities and precipitates remained in the final product as few as possible. Since the method for manufacturing the grain-oriented silicon steel sheet through two stages of cold rolling has been invented by N. P. Gross, a large number of improvements have ever been made in the elaborated production methods, and the magnetic induction and iron loss have been improved year by year. Among them, the typical processes include the utilization of the precipitated particle of AlN disclosed in Japanese Pat. No. 461,576 and the addition of Sb and Se or S disclosed in Japanese Pat. No. 839,079 and these processes have been able to produce the products having $B_{10}$ greatly exceeding 1.85 Wb/m$^2$. However, the former process has the defect that the acceptance is very narrow in the commercial production and the latter can effect the production commercially stably but the magnetic induction is comparatively low.

An object of the present invention is to obviate the above-described drawbacks of previously known grain-oriented silicon steel sheets and to provide a method for producing very stable grain-oriented silicon steel sheets having a high magnetic induction of $B_{10}$ of not less than 1.94 Wb/m$^2$. The present invention also comprises a method for producing grain-oriented silicon steel sheets having both magnetic properties of a very high magnetic induction and a low iron loss. It can be manufactured by hot rolling a silicon steel material containing not more than 0.06% of C, 2.0–4.0% of Si, 0.005–0.20% of Sb and not more than 0.10% of at least one of Se and S, repeating annealing and cold rolling processes properly to obtain a cold rolled steel sheet of a final gauge, decarburizing the cold rolled sheet together the formation of the primary recrystallization, and then subjecting the thus treated steel sheet to the final annealing to grow the secondary recrystallized grains of {110}<100> orientation, said process being characterized in that 0.003–0.1% of Mo is contained in the above described silicon steel material.

In the present invention, a small amount of Mo and Sb and a slight amount of at least one of Se and S act as inhibitors to inhibit effectively the normal grain growth during secondary annealing in the production of grain-oriented silicon steel sheet. In the present invention, in the same manner as the conventional method for producing grain-oriented silicon steel sheets, the silicon steel material containing appropriate amounts of inhibitors is subjected to the cold rolling, if necessary with an intermediate annleaing to obtain the final gauge, the thus obtained sheet is subjected to the primary recrystallization annealing under a wet hydrogen to effect together decarburization and then to the final annealing generally at a temperature of 1,100°–1,200° C., whereby the secondary recrystallized grains having {110}<100> orientation are selectively grown during the final annealing and simultaneously the growth of primary grains deviated from {110}<100> orientation is inhibited effectively by the coexistence of the precipitates or the solution atoms segregated to the grain boundary, that is formed by small amounts of inhibitors.

As mentioned above, the essential feature of the present invention consists in that the silicon steel material contains a small amount of Mo and Sb, and a slight amount of at least one of Se and S.

The use of Mo in the production of a grain-oriented silicon steel sheet has been proposed in Japanese Patent Laid-Open application No. 24116-77, in which 0.005–1.0% of at least one of carbide or nitride forming elements, such as Mo, Zr, Ti, B, Nb, Ta, V, Cr and the like is added together with AlN in the production of the grain-oriented silicon steel sheet. The addition of Mo in this prior art aims to vary the precipitating behavior of AlN and to lower the temperature for heating the slab. Therefore, the object of the addition of Mo in this prior art is quite different from that in the present invention. The present invention is characterized in that Mo can be used as an inhibitor and has found that the addition of 0.003–0.1% of Mo together with Sb and at least one of Se and S considerably strengthens the effect for inhibiting the growth of the primary recrystallized grains and plays the noticeable role for developing secondary recrystallized grains of {110}<100> orientation during the secondary recrystallization annealing.

It has been known by Japanese Patent Application Publication No. 8214-63 that the secondary recrystallized grains having {110}<100> orientation are obtained by adding 0.005–0.1% of Sb and the inventors have disclosed in Japanese Pat. No. 839,079 that the addition of 0.005–0.2% of Sb and a slight amount of Se or S inhibits the growth of the primary recrystallized grains. The present invention has improved and developed the inventions of the above described prior arts, i.e., by the addition of the appropriate amount of Mo, the growth of the primary recrystallized grains is inhibited more effectively and the secondary recrystallized grains of {110}<100> orientation can be obtained. Therefore, the excellent magnetic properties can be steadily obtained and the present invention can be accomplished.

The invention will be explained in more detail.

For better understanding of the invention, reference is taken to the accompanying drawings, wherein.

The present invention will be explained with respect to the experimental data.

Figure 1:
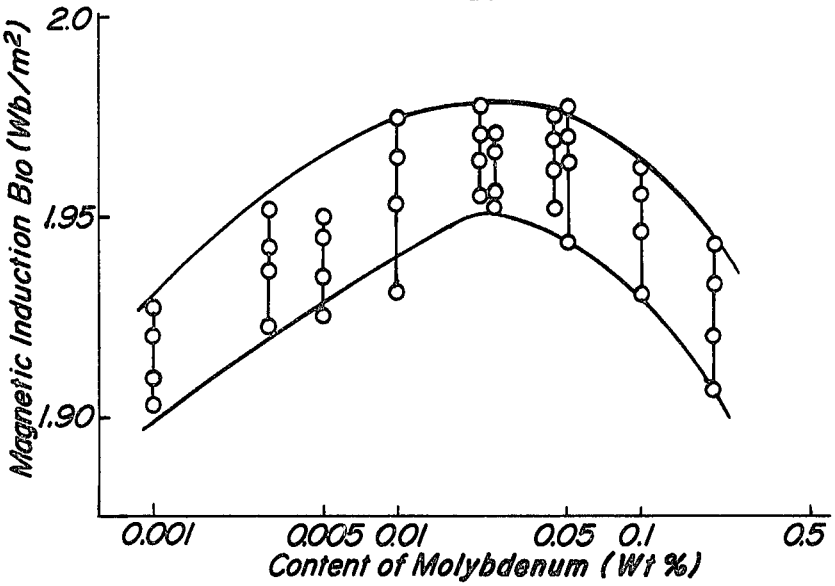
FIG. 1 shows the relation of the content of Mo to the magnetic induction.

Steel ingots containing about 0.035% of C, about 3.0% of Si, 0–0.2% of Mo, about 0.025% of Sb and about 0.018% of Se were hot rolled to form hot rolled steel sheets having a thickness of 3 mm, these hot rolled sheets were subjected to normalizing annealing at 950° C. for 5 minutes and then cold rolled at a reduction rate of 60–80%, subjected to intermediate annealing at 950° C. for 5 minutes and finally cold rolled at a reduction rate of 50–70% to a final gauge of 0.30 mm or 0.35 mm. The thus treated sheets were decarburized in wet hydrogen at 820° C. and then secondary recrystallized at 865° C. for 50 hours and subjected to box annealing at 1,180° C. The relation of the content of Mo to the magnetic induction $B_{10}$ of the obtained products is shown in FIG. 1. As seen from FIG. 1, when Mo is not added or the content of Mo is less than 0.001%, $B_{10}$ value is 1.90–1.93 Wb/m$^2$. As the content of Mo increases, $B_{10}$ value increases and when the content of Mo is 0.01–0.05%, $B_{10}$ value of more than 1.94 Wb/m$^2$ is steadily obtained.

Figure 2:
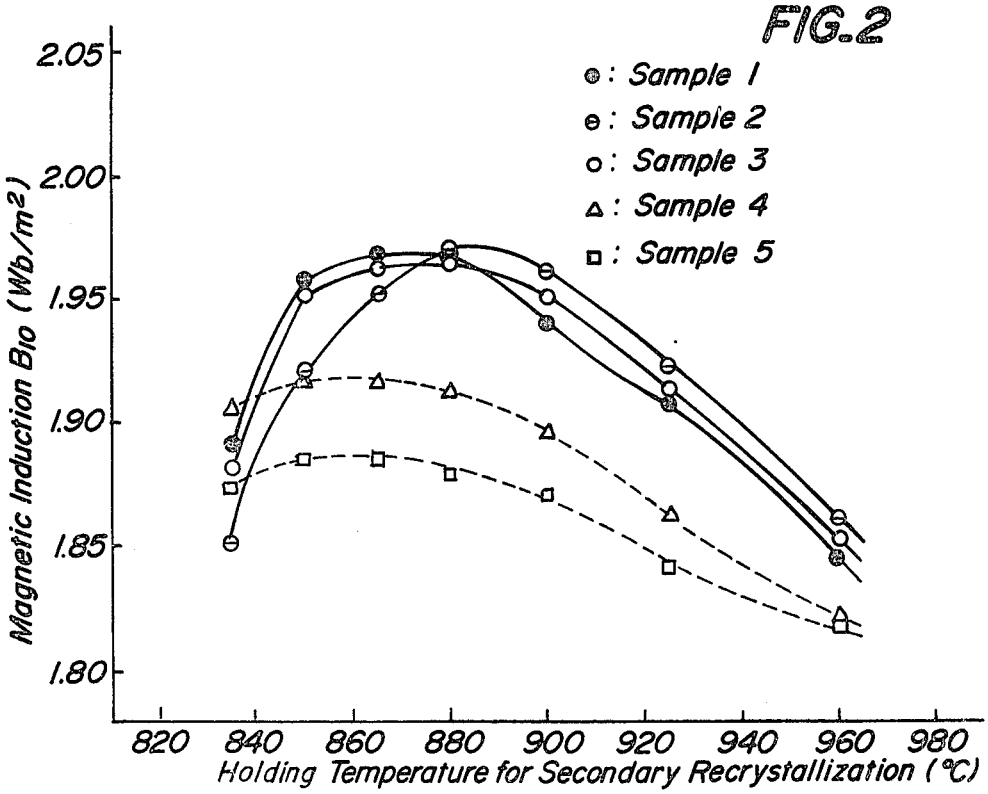
FIG. 2 shows the relation of the secondary recrystallizing temperature to the magnetic induction.

The following five steel ingots,

Sample 1: a steel ingot containing 0.038% of C, 2.9% of Si, 0.011% of Mo, 0.031% of Sb and 0.023% of Se, Sample 2: a steel ingot containing 0.038% of C, 2.9% of Si, 0.027% of Mo, 0.029% of Sb and 0.022% of Se, Sample 3: a steel ingot containing 0.041% of C, 3.2% of Si, 0.055% of Mo, 0.030% of Sb and 0.033% of Se, Sample 4: a steel ingot containing 0.032% of C, 3.0% of Si, 0.026% of Sb and 0.024% of Se, and Sample 5: a steel ingot containing 0.038% of C, 2.95% of Si and 0.030% of Se were hot rolled to obtain hot rolled sheets having a thickness of 2.7–3.0 mm, the hot rolled sheets were subjected to normalizing annealing at 950° C. for 5 minutes and then cold rolled at a reduction rate of 60–80%, subjected to intermediate annealing at 950° C. for 5 minutes, finally cold rolled at a reduction rate of 50–70% to obtain a final gauge of 0.3 mm and then the thus obtained sheets were decarburized in wet hydrogen at 820° C., and finally subjected to secondary recrystallization annealing at a given each temperature for 50 hours by varying the temperature from 820° C. to 960° C. and then purification annealing at 1,180° C. for 5 hours. The relation of the magnetic induction to the varied secondary recrystallization temperatures of the obtained products is shown in FIG. 2. As seen from FIG. 2, the magnetic properties are noticeably improved only when small amounts of Mo, Sb and Se are added. The optimum temperature for the secondary recrystallization by the addition of Mo is about 15°–20° C. higher than the cases where Se alone or Se and Sb are added and among them, the case where Mo, Se and Sb are added is the highest in the ability for inhibiting the growth of the primary recrystallized grains. Even in the case of the combined addition of Mo and Se, about 1.94 Wb/m$^2$ of magnetic induction $B_{10}$ is obtained but the additional addition of Sb provides stably the higher magnetic induction.

Then, the reason for limiting the composition of the silicon steel material components in the present invention will be explained.

When C exceeds 0.06%, the necessary time for decarburization becomes longer and such a content is not economic, so that the content of C must be not more than 0.06%.

When the content of Si is less than 2.0%, the electric resistance is low and the iron loss value due to increase of eddy current loss becomes larger, while when said content is more than 4%, brittle cracks are apt to be caused upon cold rolling, so that Si must be 2–4%.

When the content of Mo is less than 0.003%, the effect for inhibiting the growth of the primary recrystallized grains is low, while when said content exceeds 0.1%, the hot and cold processabilities are deteriorated and the iron loss increases, so that the content of Mo must be 0.003–0.1%.

Concerning Sb, it has been known by Japanese Patent application Publication No. 8214-63 and Japanese Pat. No. 839079 respectively that the growth of the primary recrystallized grains is inhibited by containing 0.005–0.1% of Sb and a slight amount of Se or S. In the present invention, it is necessary to contain the given amounts of Mo, Sb and at least one of Se and S in the raw material but when the content of Sb is less than 0.005%, the effect for inhibiting the growth of the primary recrystallized grains is low, while when said content exceeds 0.2%, the magnetic induction lowers and the magnetic properties are deteriorated, so that the content of Sb must be 0.005–0.2%.

When the content of Se or S or the total content of Se and S exceeds 0.10%, the hot processability and the iron loss are deteriorated, so that said content must be not more than 0.10%.

In the present invention, it is permissible to contain unavoidable elements added in conventional silicon steels. For example, it is preferable to contain 0.02–0.2% of Mn. In addition, it is acceptable to contain a slight amount of usual incidental elements of Cu, B, Cr, Ti, V, Zr, Nb, Ta, Co, Ni, Sn, P and As. Furthermore, even if Al used as a deoxidizer is remained in a slight amount, for example less than 0.01%, the effect of the present invention satisfactorily appears. However, an amount of Al contained in steel sheets is usually less than 0.005%. Moreover, it is admissible to substitute Te in place of the inhibitor for Se or S or to additionally add a small amount of Te.

In the present invention, the silicon steel material containing the above described composition is produced by the usual well known steel making and casting process and said material is hot rolled in the well known manner and method, subjected to at least one annealing step and at least one cold rolling step to obtain the final gauge, and the obtained sheet was subjected to the decarburization annealing and the final annealing to grow the secondary recrystallized grains highly oriented in {110}<100> orientation.

The raw materials according to the present invention may be melted by using LD converter, electric furnace, open hearth furnace and the other well known steel making processes and by using together vacuum treatment or vacuum melting. The ingot may be formed by usually pouring the molten steel into a mold or by a continuous casting.

According to the present invention, Mo, Sb and at least one of S, Se and Te to be contained in the raw material may be added in the molten steel by using any one of previously well known processes, for example in LD converter or the molten steel when RH degassing or forming ingot.

The formed steel ingot or continuously cast slag is hot rolled by well known processes. In general, the slab is naturally hot rolled into a strip and the thickness of the hot rolled steel sheet is advantageously usually about 2–5 mm. Then, the hot rolled sheet is cold rolled and the cold rolling is conducted one or more times, if necessary with an intermediate annealing. In order to obtain the high $B_{10}$ value aimed in the present invention, it is necessary to pay attention to the final cold rolling reduction rate.

Figure 3:
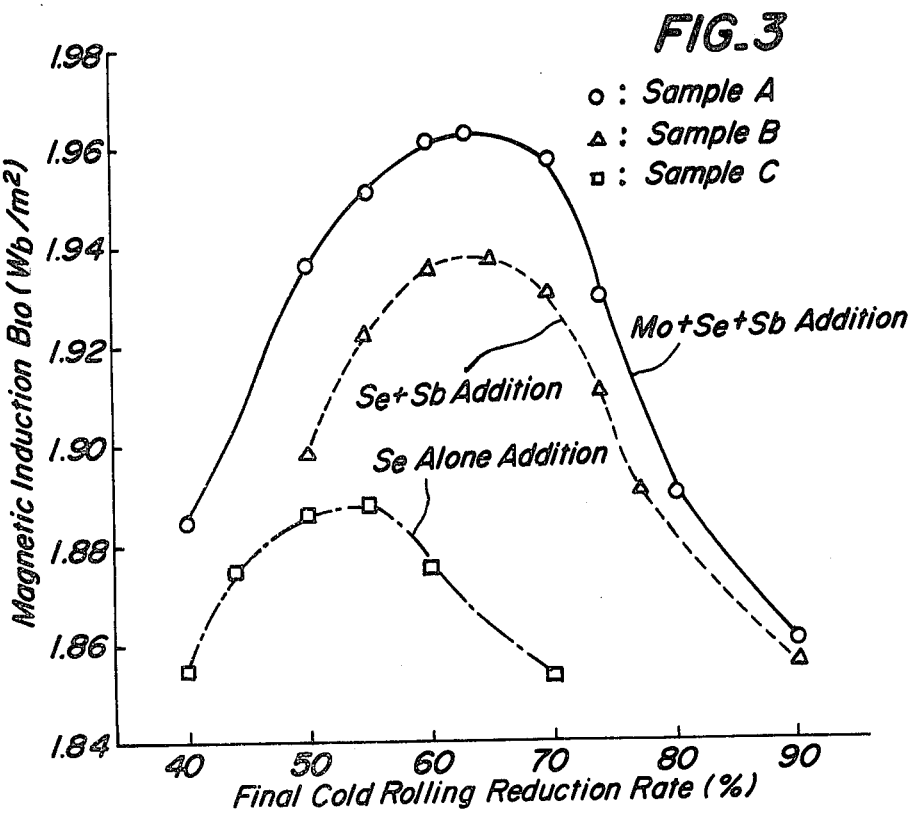
FIG. 3 shows the relation of the final cold rolling reduction rate to the magnetic induction.

FIG. 3 shows the relation of the final cold rolling reduction rate of the products plotted against the magnetic induction $B_{10}$. To molten steel containing about 0.035% of C, about 3% of Si and about 0.055% of Mn, 0.025% of Mo, 0.025% of Sb and 0.018% of Se (Sample A) are added, 0.028% of Sb and 0.020% of Se (Sample B) are added or 0.022% of Se (Sample C) is added to obtain steel ingots. Ingots are hot rolled to a thickness of 3 mm, the hot rolled steel sheets are annealed at 950° C. for 5 minutes, cold rolled at a reduction rate of 40–85%, annealed at 950° C. for 5 minutes and then final cold rolled at a reduction rate of 40–90% to a final gauge of 0.30 mm, after which the thus treated sheets are decarburized at 830° C. in wet hydrogen and finally annealed at 865° C. for 50 hours to induce the secondary recrystalbization, and then subjected to box annealing at 1,180° C. to obtain Samples A, B and C.

According to the present invention, it can be seen from FIG. 3 that the high magnetic induction $B_{10}$ value can be obtained at the final cold rolling reduction rate of 40–80% in the raw material. In particular, the final cold rolling reduction rate of 55–70% can provide $B_{10}$ value exceeding 1.95 Wb/m$^2$. At the final cold rolling reduction rate of more than 80%, the secondary and primary recrystallized grains are mixed and $B_{10}$ value lowers. On the other hand, when the reduction rate is less than 40%, large secondary recrystallized grains are obtained but such secondary grains are deviated from {110}<100> orientation and $B_{10}$ value also lowers.

The cold rolling is usually carried out two times with an intermediate annealing and the reduction rate in the first cold rolling is about 50–80%. In advance of cold rolling, if the hot rolled steel sheet is annealed at a temperature range of 850°–1,100° C. to make the hot rolled structure homogeneous, the high magnetic induction can be obtained.

These annealings are usually conducted by conventional continuous annealing method and may be substituted with well known method such as box annealing. The steel sheet cold rolled to the final gauge is subjected to the decarburizing annealing. This annealing treatment aims to transform the cold rolled structure into the primary recrystallized structure and simultaneously to remove carbon which is harmful when the secondary recrystallized grains of {110}<100> orientation are grown during the final annealing. This process may be used by any well known method, for example annealing at a temperature of 750°–850° C. for 3–15 minutes in wet hydrogen.

The final annealing is carried out for fully growing the secondary recrystallized grains of {110}<100> orientation and immediately raised to a temperature of higher than 1,000° C. by box annealing and kept to the said temperature for several hours, in order to remove the impurities contained in the steel sheet. This final annealing is generally carried out after coating an annealing separator, such as magnesia. In the present invention, in order to grow the secondary recrystallized grains highly aligned to {110}<100> orientation, it is necessary to conduct the long time annealing for 10–80 hours at a low temperature of 820°–900° C. That is, as seen from FIG. 2, when the secondary recrystallization annealing temperature is higher than 960° C., $B_{10}$ value is not fully improved and it is difficult to obtain more than 1.90 Wb/m$^2$. On the other hand, even though the secondary recrystallization occurs at an annealing temperature of lower than 820° C., the necessary time becomes too long and such a temperature is not commercially preferable. Accordingly, in the present invention, the secondary recrystallizing temperature should be within the range of 820°–950° C. The characteristic of the present invention consists in that the secondary recrystallized grains are fully grown within this temperature range and as far as the object is attained, the means may be maintenance of the temperature of 820°–950° C. for 10–80 hours of the commercially possible gradual heating within this temperature range, for example at the temperature raising rate of 0.5°–15° C./hr.

Figure 4:
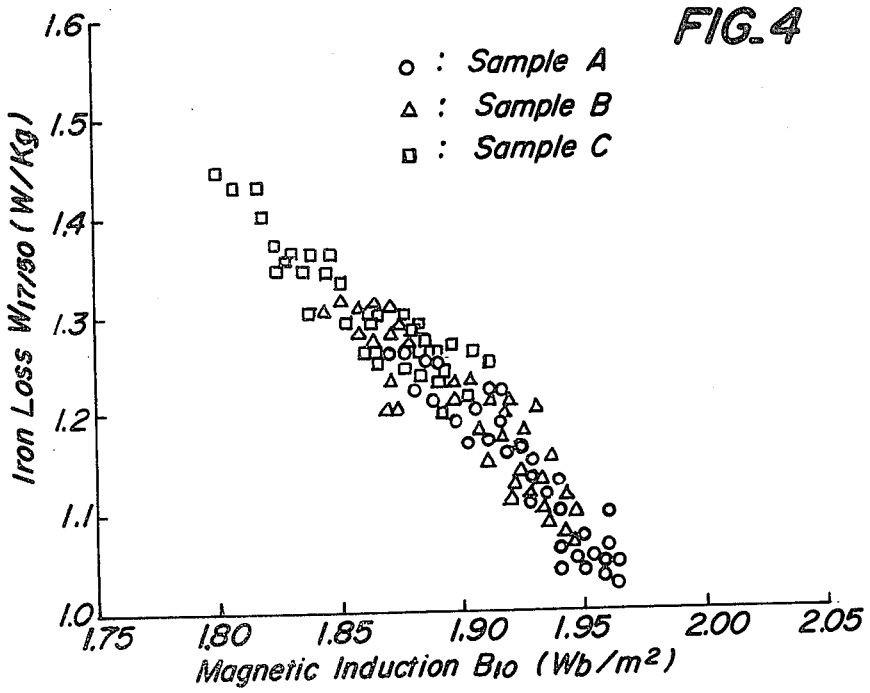
FIG. 4 shows the relation of the iron loss to the magnetic induction.

FIG. 4 shows an embodiment of relation of $B_{10}$ value to the magnetic induction when the treatment was done in the same manner as in FIG. 3. Even if Mo and Sb remain in the steel sheet, the iron loss does not lower and as seen from FIG. 4, in Sample A, the iron loss $W_{17/50}$ of less than 1.1 W/kg can be stably obtained.

The following examples are given for the purpose of illustration of this invention and are not intended as limitations thereof.

EXAMPLE 1

A steel ingot containing 0.032% of C, 2.96% of Si, 0.065% of Mn, 0.015% of Mo, 0.025% of Sb and 0.018% of Se was hot rolled to a thickness of 3 mm, the hot rolled sheet was normalized by annealing at 950° C. for 5 minutes, cold rolled at a reduction rate of 75%, intermediately annealed at 900° C. for 5 minutes and again cold rolled at a reduction rate of 63% to obtain the final gauge of 0.3 mm. The thus cold rolled sheet was decarburized in wet hydrogen at 820° C. for 10 minutes and secondary recrystallized at 865° C. for 40 hours, after which the temperature was raised to 1,200° C. and the thus treated sheet was purified by annealing in hydrogen for 5 hours. The obtained product has the following magnetic properties.

$B_{10}$: 1.96 Wb/m$^2$
$W_{17/50}$: 1.04 W/kg

EXAMPLE 2

A silicon steel ingot containing 0.031% of C, 2.98% of Si, 0.070% of Mn, 0.030% of Mo, 0.030% of Sb and 0.020% of S was heated at 1,340° C. for 3 hours and hot rolled to a thickness of 3 mm. The hot rolled sheet was normalized by annealing at 900° C. for 5 minutes and cold rolled at a reduction rate of about 75%, intermediately annealed at 950° C. for 5 minutes and then cold rolled at a reduction rate of 63% to a final gauge of 0.3 mm. The cold rolled sheet was decarburized by annealing at 800° C. for 10 minutes and subjected to secondary recrystallization annealing at 860° C. for 30 hours and then purified by annealing at 1,180° C. for 5 hours in hydrogen. The silicon steel sheet having the following properties was obtained.

$B_{10}$: 1.94 Wb/m$^2$
$W_{17/50}$: 1.10 W/kg

EXAMPLE 3

A silicon steel ingot containing 0.029% of C, 3.01% of Si, 0.058% of Mn, 0.009% of Mo, 0.018% of Sb, 0.011% of S and 0.013% of Se was hot rolled to a thickness of 1.8 mm, the hot rolled sheet was normalized by annealing at 1,000° C. for 3 minutes and then rolled at a reduction rate of about 80% to a final gauge of 0.35 mm. In the rolling, the coil was heated at 300° C. and hot rolled. The hot rolled sheet was subjected to decarburizing and finishing annealing. The properties of the obtained product are as follows.

$B_{10}$: 1.92 Wb/m$^2$ $W_{17/50}$: 1.18 W/kg

EXAMPLE 4

A continuous slab containing 0.032% of C, 2.96% of Si, 0.039% of Mn, 0.020% of Mo, 0.015% of Sb and 0.020% of Se was hot rolled to a thickness of 3 mm, the hot rolled sheet was normalized by annealing at 900° C. for 5 minutes and cold rolled at a reduction rate of 75%, intermediately annealed at 950° C. and then cold rolled at a reduction rate of 60% to a final gauge of 0.3 mm. The cold rolled sheet was subjected to decarburizing and finishing annealing at 1,200° C. for 5 hours. The obtained product has the following properties.

$B_{10}$: 1.94 Wb/m$^2$ $W_{17/50}$: 1.08 W/kg

EXAMPLE 5

A hot rolled sheet containing 0.035% of C, 2.90% of Si, 0.005% of Mo, 0.025% of Sb and 0.02% of Se was obtained and this sheet was cold rolled at a reduction rate of about 70% and intermediately annealed at 950° C. and cold rolled at a reduction rate of 60% to finish into a thickness of 0.3 mm. After decarburization, the sheet was gradually heated at a rate of 5° C./hr from 800° C. to 1,050° C. and a temperature of 1,180° C. was kept for 5 hours. The magnetic properties are as follows.

$B_{10}$: 1.95 Wb/m$^2$ $W_{17/50}$: 1.07 W/kg

As mentioned above, the present invention can provide very stable grain-oriented silicon steel sheets having a high magnetic induction of $B_{10}$ of more than 1.94 Wb/m$^2$ and a low iron loss.

What is claimed is:

1. In a method for producing grain-oriented silicon steel sheets having a very high magnetic induction and a low iron loss, in which a silicon steel material containing not more than 0.06% of C, 2.0–4.0% of Si, 0.005–0.20% of Sb and not more than 0.10% of at least one of Se and S is hot rolled and the hot rolled sheet is repeatedly subjected to annealing and cold rolling to obtain a cold rolled steel sheet having a final gauge, then subjected to primary recrystallizing annealing concurrently to effect decarburization, and to final annealing at a temperature of 820°–900° C. for 10–80 hours, and to grow secondary recrystallized grains of [110] <100> orientation, the improvement comprises adding Mo of 0.01 to 0.10% to the above-described silicon steel material as an inhibitor.

2. The method as claimed in claim 1, wherein not more than 0.10% of at least one of Se, S and Te is added to the silicon steel material.

* * * * *